US006846204B2

(12) United States Patent
Oda

(10) Patent No.: US 6,846,204 B2
(45) Date of Patent: Jan. 25, 2005

(54) ELECTRICAL CONNECTOR BOX

(75) Inventor: Akihiro Oda, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/635,576

(22) Filed: Aug. 7, 2003

(65) Prior Publication Data

US 2004/0033730 A1 Feb. 19, 2004

(30) Foreign Application Priority Data

Aug. 12, 2002 (JP) ..... 2002-235208

(51) Int. Cl.[7] ..... H01R 9/22
(52) U.S. Cl. ..... 439/709; 439/949; 439/801
(58) Field of Search ..... 439/211, 212, 439/214, 76.2, 621, 622, 709, 721–724, 778, 779, 801, 813, 949

(56) References Cited

U.S. PATENT DOCUMENTS 4,142,225 A * 2/1979 Diersing et al. ..... 361/647
4,538,879 A * 9/1985 Wagener ..... 439/211
5,088,940 A 2/1992 Saito
5,108,296 A * 4/1992 Takano et al. ..... 439/92
5,645,457 A 7/1997 Hirayama et al.
5,795,193 A 8/1998 Yang
5,825,085 A * 10/1998 Masumoto et al. ..... 257/704
6,132,257 A * 10/2000 Wang et al. ..... 439/622
2004/0029419 A1 * 2/2004 Uezono ..... 439/76.2

FOREIGN PATENT DOCUMENTS

JP 1012292 1/1998
JP 200152772 2/2001

OTHER PUBLICATIONS

English Language Abstract of JP Appln. No. 2001–12292.
English Language Abstract of JP Appln. No. 2001–52772.

* cited by examiner

*Primary Examiner*—Gary Paumen
*Assistant Examiner*—James R. Harvey
(74) *Attorney, Agent, or Firm*—Greenblum & Bernstein, P.L.C.

(57) ABSTRACT

An electrical connector box configured to prevent damage to an integrally formed nut supporting bracket from a bolt tightening load. The electrical connector box includes a nut supporting bracket into which a threaded nut is molded, a circuit bus bar, and an electrical power lead terminal connector. The circuit bus bar and terminal connector are attached to the upper surface of the nut bracket by a threaded bolt. A reinforcement bus bar is angled downward from one side of a bolt attachment surface, and extends downwardly along one side of the nut bracket between an outer wall of the nut bracket and the vertical portion of the circuit bus bar.

11 Claims, 8 Drawing Sheets

ELECTRICAL CONNECTOR BOX

BACKGROUND OF THE INVENTION

1. Field of the Invention

The present invention relates to an electrical connector box, and particularly to an automotive electrical connector box including a threaded bolt that attaches an electrical wire terminal to a bus bar, a nut molded into a nut bracket positioned beneath the bus bar, and a nut holding portion of the nut bracket reinforced to prevent damage to the nut bracket when the bolt is tightened.

2. Description of the Related Art

Japanese Kokai Patent 2001-52772 discloses a terminal attachment structure as illustrated in FIG. 6. Electrical connector box 1 includes attachment fixture 2*a* that projects from the outer wall of case 2, and threaded bolt 3 is molded into the inner portion of attachment fixture 2*a*. Bolt hole 4*a*, which is formed within LA terminal 4 on the end of power lead 'w', is placed over bolt 3, and nut 5 is tightened on bolt 3 to make the electrical connection. Attachment fixture 2*a* contains a bus bar (not illustrated in the drawing) that connects to bolt 3, extends into the internal portion of case 2, and joins to an electrical circuit contained therein.

Furthermore, as illustrated by the connector box structure 1' in FIGS. 7 and 8, in order to connect the bus bar to the power supply wire, nut bracket 2*b*' is formed as an integral part of electrical connector box 1' with one end of bus bar 6 extending over the upper surface of nut bracket 2*b*' into which nut 5 is molded. The end of bus bar 6 is placed over the upper surface of nut 5; the bolt hole in bus bar 6 is aligned over nut 5; LA terminal 4, to which the terminal end of power lead 'w' is attached, is placed against the upper surface of bus bar 6; and bolt 7 is inserted into the bolt holes provided in the LA terminal and bus bar, and tightened into nut 5. Nut 5 is buried within the center portion of the top wall of nut bracket 2*b*' which is formed with an open passage that aligns with the nut, and indented outer wall 2*d*' extends downward from the end of the top wall.

The connector box shown in FIG. 6 exhibits an undesirable feature in that attachment fixture 2*a* projects outward from the connector box case and thus increases the size of the connector box. Also, there is a risk that attachment part 2*a* may be damaged when nut 5 is tightened on bolt 3 even though fixture 2*a* is required to support the torque needed to attach nut 5.

Moreover, as illustrated by the connector box structure shown in FIGS. 7 and 8, in order to locate the power supply wire and bus bar connection within the connector box case to eliminate the problem of the attachment part adding to the size of the case, thin wall section X, which is the portion of nut bracket 2*b*' at outer wall 2*d*', must be narrowed to provide for an adequate wire insertion space 'S' between bus bar 6 and the outer wall. Thus, it is likely that thin wall section X will be damaged by the torque applied to tighten the bolt into nut 5, thereby posing the same type of connection support problem as noted for the structure illustrated in FIG. 6.

SUMMARY OF THE INVENTION

Noting the above described shortcomings in the prior art structures, an aspect of the present invention provides reinforcement of the nut bracket to prevent breakage of the nut bracket when a bolt is tightly attached thereto.

The present invention includes an electrical connector box that includes a nut bracket into which a threaded nut is molded, a circuit bus bar, and an L-shaped electrical power lead terminal connector. The circuit bus bar and terminal connector are attached to the upper surface of the nut bracket by a threaded bolt that joins the threaded nut by passing through bolt holes provided in the L-shaped terminal connector and the circuit bus bar. In particular, the present invention includes a reinforcement bus bar that bends downwardly from one side of the bolt attachment surface of the circuit bus bar, and extends downwardly along one side of the nut bracket between an outer wall of the nut bracket and a vertical portion of the circuit bus bar.

The circuit bus bar of the present invention may be positioned within a narrow passage between an outer wall of the nut bracket and the external case wall. The reinforcement bus bar of the present invention may be positioned on the outer wall of the nut bracket and against the circuit bus bar, thus forming a structure in which the reinforcement bus bar and circuit bus bar are in mutual contact. As a result of this structure, heat is efficiently dissipated through the bus bars, and damage to the nut bracket, which otherwise might be inflicted from the load generated by tightening the terminal attachment bolt, can be prevented due to the outer wall of the nut bracket being reinforced through contact with the bus bars.

Further, as the reinforcement bus bar can be incorporated with no modification to prior art case structures, the expense of developing new tooling to manufacture a new case is eliminated.

In the present invention, the lower ends of the circuit bus bar and the reinforcement bus bar may be bent, and the bent portions may be attached, in mutual contact, to an outer wall of the nut bracket. A structure is thus formed that improves the heat dissipation capability of the circuit bus bar and allows the reinforcement bus bar itself to be fixedly secured along an outer wall of the nut bracket.

Moreover, in the present invention, the circuit bus bar may be configured as a C-shaped member, the reinforcement bus bar may be configured as a U-shaped member, and the lower parts of both bus bars may be mutually bolted together. One vertical portion of the reinforcement bus bar may reinforce a nut bracket wall other than the wall along which another vertical part of the reinforcement bus bar is located.

Additionally, lengthening the ends of the U-shape of the reinforcement bus bar will improve heat dissipation, and placing the extending ends of the reinforcement bus bar against two opposing nut bracket walls makes it possible to increase the strength of the nut bracket.

An aspect of the present invention provides an electrical connector box including a nut bracket and a threaded nut molded therein, a circuit bus bar, and an L-shaped electrical power lead terminal connector, the circuit bus bar and the L-shaped terminal connector configured to be attached to an upper surface of the nut bracket by a threaded bolt fastened to the nut by passing through bolt holes provided in the L-shaped terminal connector and the circuit bus bar, the electrical connector box including a reinforcement bus bar extending downwardly along a first outer wall of the nut bracket between the first outer wall of the nut bracket and a vertical portion of the circuit bus bar. Further, lower ends of the circuit bus bar and the reinforcement bus bar may be angled and joined together by a threaded bolt. The circuit bus bar may be configured as a C-shaped member, the reinforcement bus bar may be configured as a U-shaped member, lower portions of both the circuit bus bar and the reinforcement bus bar may be bolted together, and a vertical portion of the reinforcement bus bar may reinforce a nut bracket wall other than the first outer wall along which the reinforcement bus bar extends downwardly.

A further aspect of the present invention provides an electrical connector box including a case; a nut bracket provided integrally with the case, the nut bracket including a threaded nut molded into an upper portion thereof, a first outer wall extending downwardly from the upper portion, and a thin walled section of the first outer wall provided in the upper portion adjacent the threaded nut, the threaded nut configured for receiving a threaded bolt therein; a wiring space defined between a case wall and the nut bracket first outer wall; a terminal connector including a bolt hole, the terminal connector fastened to an upper surface of the upper portion of the nut bracket by the threaded nut and a bolt; a circuit bus bar including a bolt hole, the circuit bus bar fastened to the upper surface of the upper portion of the nut bracket by the threaded nut and bolt, the circuit bus bar including a vertical portion extending downwardly from the upper portion of the nut bracket into the wiring space between the case wall and the nut bracket first outer wall; and a reinforcement member including a first vertical portion extending downwardly into the wiring space between the nut bracket first outer wall and the circuit bus bar vertical portion, wherein the reinforcement member and the circuit bus bar fill the wiring space and protect the thin walled section from damage due to bolt tightening. The nut bracket further includes a second outer wall extending downwardly from the upper portion, the second outer wall positioned opposite the first outer wall, and the first and second outer walls extending to a lower portion of the nut bracket; and the reinforcement member includes a horizontal portion extending along a lower surface of the lower portion of the nut bracket and a second vertical portion extending upwardly from the lower portion of the nut bracket along the second outer wall so that the first vertical portion, the horizontal portion, and the second vertical portion of the reinforcement member form a U-shaped member. Further, the circuit bus bar may include a first horizontal portion extending along the upper surface of the nut bracket and a second horizontal portion extending along the lower surface of the lower portion of the nut bracket so that the first horizontal portion, the vertical portion, and the second horizontal portion of the circuit bus bar form a C-shaped member.

According to a further aspect of the present invention, the nut bracket further includes a second threaded nut molded into the lower portion of the nut bracket; and the horizontal portion of the reinforcement member and the second horizontal portion of the circuit bus bar each include a bolt hole therein, the reinforcement member and the circuit bus bar connected to the lower portion of the nut bracket by a threaded bolt through the bolt holes and fastened to the second threaded nut. Further, the reinforcement member and the circuit bus bar are positioned in contact with each other such that heat dissipation is promoted.

In a further aspect of the present invention, the electrical connector box further includes a second circuit bus bar including a bolt hole, the second circuit bus bar extending along the lower surface and connected to the lower portion of the nut bracket by the second threaded nut and bolt. Further, the terminal connector may include an L-shaped terminal connector including a horizontal portion and a vertical portion, the vertical portion including a lead crimped in a crimping collar of the L-shaped terminal. Further, the nut bracket may further include a third outer wall between the first and second outer walls and extending downwardly from the upper portion; the horizontal portion of the L-shaped terminal connector extending along the upper surface of the nut bracket and the vertical portion of the L-shaped terminal connector extending along the third outer wall.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

Figure 1:
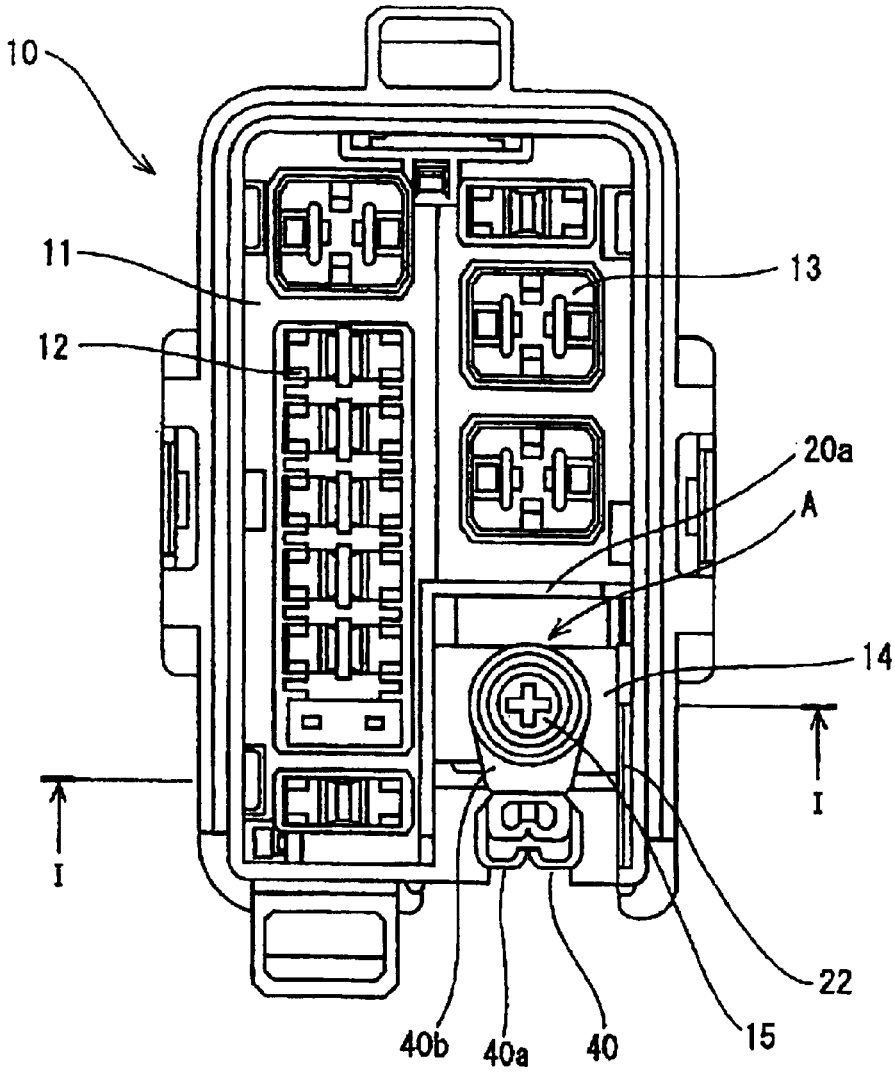
FIG. 1 is a plan view of an embodiment of the electrical connector box of the present invention.
Figure 2:
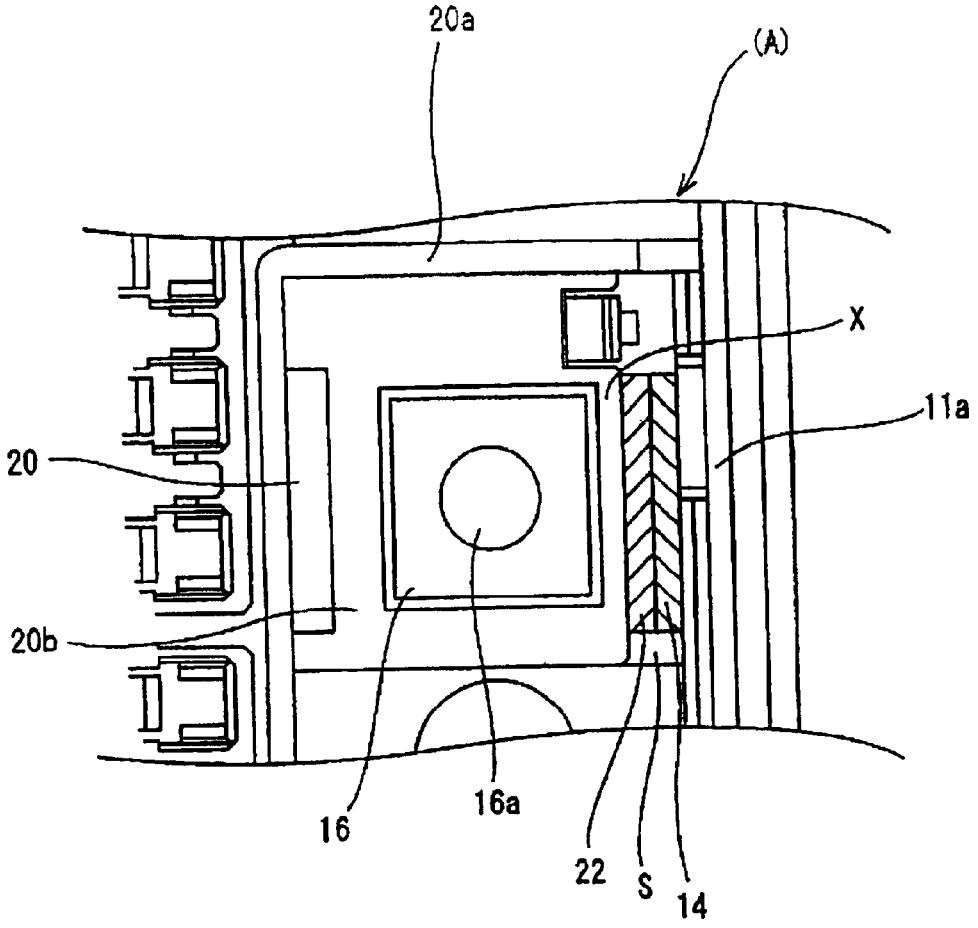
FIG. 2 is an enlarged partial view of the electrical connector box of the embodiment of FIG. 1.
Figure 3:
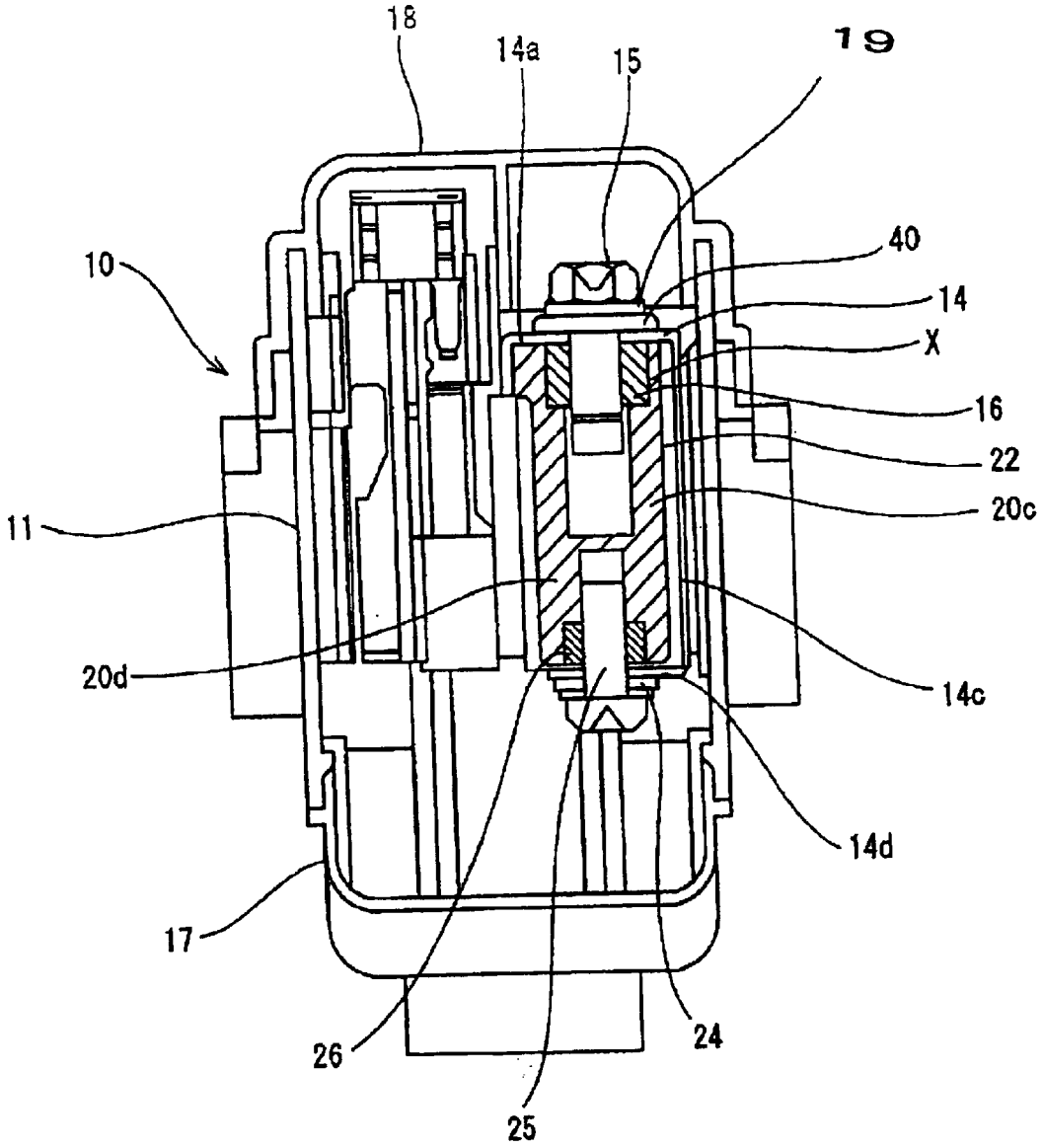
FIG. 3 is a cross sectional view of the electrical connector box taken along line I—I in FIG. 1.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe an embodiment of the invention with reference to FIGS. 1 through 5. Electrical connector box 10 may take any form, and in the present embodiment, is constructed in the form of an electrical junction box. The electrical connector box 10 includes fuse receptacles 12 on the upper surface of case 11, relay receptacles 13, power lead connector A located at one corner of the box, circuit bus bar 14 which connects to circuits located within the internal region of case 11, and bolt 15 and nut 16 that, when joined together, secure electrical power lead 'w' to circuit bus bar 14. Lower cover 17 and upper cover 18 are attached to their respective sides of case 11.

Power lead connector A is attached to nut bracket 20 which is formed as an integral component of case 11 at one corner of rectangular outer wall 11*a*. The nut bracket 20 may be formed unitarily and in one piece with the case 11. As illustrated in FIGS. 2 through 5, nut bracket 20 includes upper portion 20*b* which is substantially surrounded by the rectangular frame 20*a*, and nut 16 which is molded into upper portion 20*b* in alignment with a hollow center region formed therein. First outer wall 20*c*, which extends downwardly from the outer side of upper portion 20*b* of nut bracket 20, and thin wall section X, which is formed in the upper portion of first outer wall 20*c* adjacent to nut 16, define wiring space S at the case outer wall 11*a* and circuit bus bar 14. The second outer wall 20*d* of the nut bracket 20, which is opposite the first outer wall 20*c* and extends downwardly from the inward side of upper portion 20*b*, includes an indented surface (shown particularly in FIG. 3) that provides support for nut 16 which is molded into upper portion 20*b*.

Figure 4:
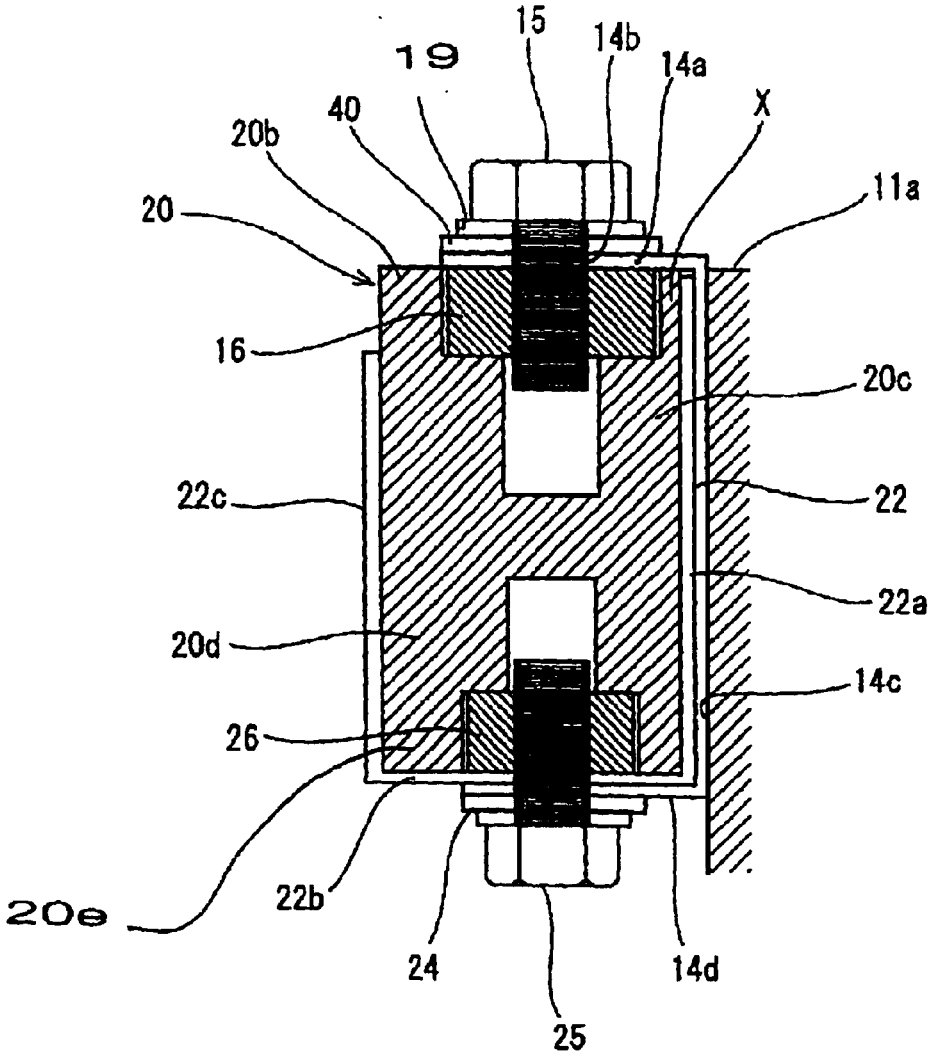
FIG. 4 is a cross sectional view of a portion of the electrical connector box as shown in FIG. 3.

As shown in FIG. 4, circuit bus bar 14, to which power lead w is connected at power lead connector A, is a C-shaped member including horizontal upper portion 14*a*, vertical portion 14*c*, and horizontal lower portion 14*d*. Power lead w connects to upper portion 14*a*, in which bolt hole 14*b* is formed, through power lead connector A, and is joined to upper portion 20*b* of the nut bracket 20 through the bolt hole 14*b* which is aligned with nut 16. Vertical portion 14*c*, which is angled downward from upper portion 14*a*, extends downwardly through space S which is positioned between the nut bracket first outer wall 20*c* and the case outer wall 11*a*. Lower portion 14*d*, which is angled horizontally from vertical portion 14*c*, extends over the downward facing end surfaces of nut bracket first outer wall 20*c* and second outer wall 20*d*.

U-shaped reinforcement bus bar 22, which provides both physical support and thermal dissipation, includes vertical portions 22*a* and 22*c*, and lower portion 22*b*. Vertical portion 22*a* is positioned between circuit bus bar 14 and nut bracket first outer wall 20*c*. The internal surface of vertical portion 22*a* extends along the entire length of nut bracket first outer wall 20*c*, including thin wall section X, and the external surface of vertical portion 22*a* maintains contact with circuit bus bar 14.

Reinforcement bus bar lower portion 22*b* covers circuit bus bar lower portion 14*d*, and is secured thereto, along with bus bar 24 which connects circuit bus bar 14 to other circuits, by inserting and tightening bolt 25 to nut 26. Nut 26 is molded into nut bracket lower portion 20*e* that connects first outer wall 20*c* and second outer wall 20*d*. Furthermore, vertical portion 22*c*, which is the part of reinforcement bus bar 22 oppositely located to vertical portion 22*a*, contacts the external surface of nut bracket second outer wall 20*d*.

Figure 5:
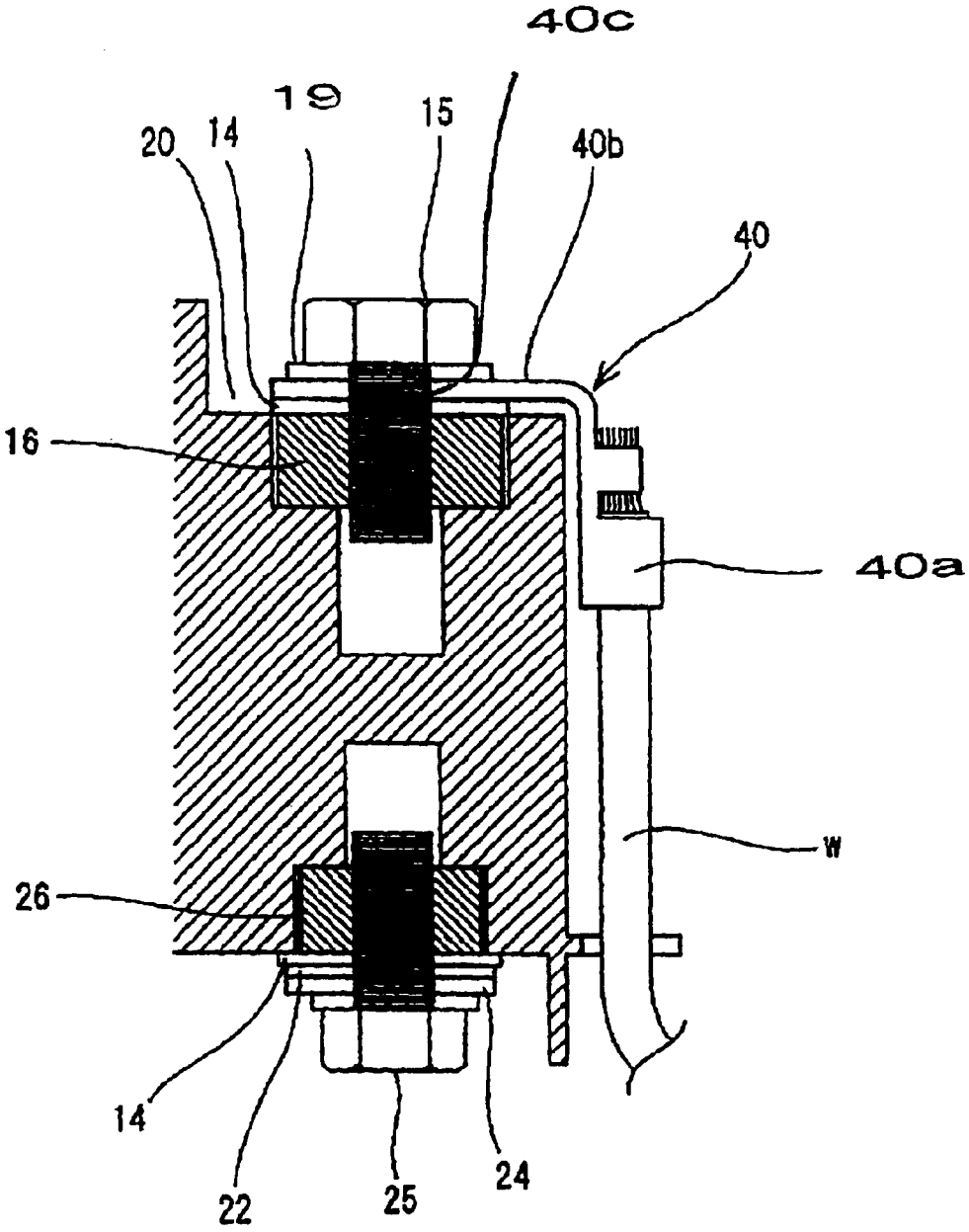
FIG. 5 is a side view of the portion of the electrical connector box shown in FIG. 4.
Figure 6:
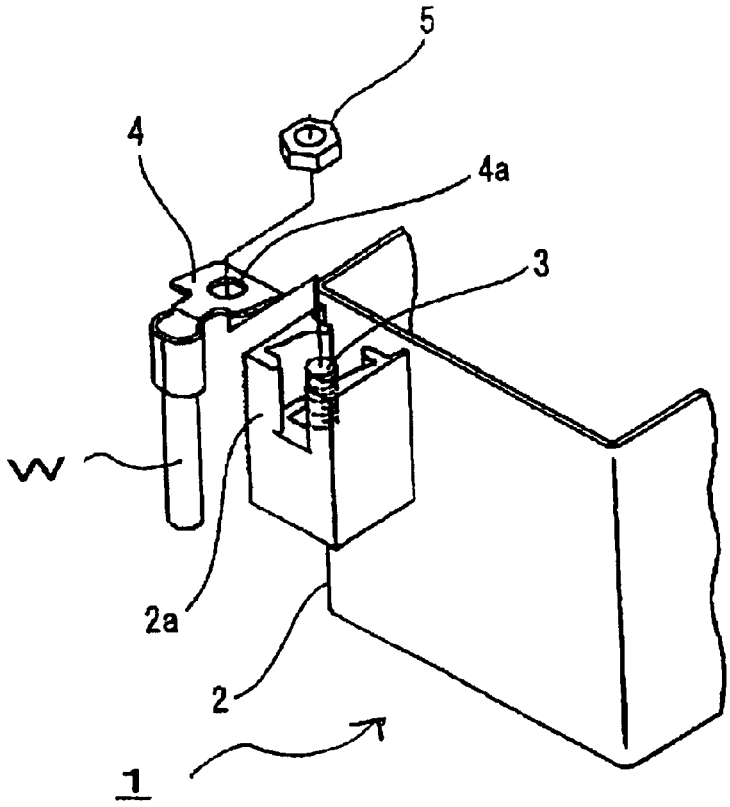
FIG. 6 PRIOR ART
FIG. 6 is a perspective view of a conventional electrical connector box.
Figure 7:
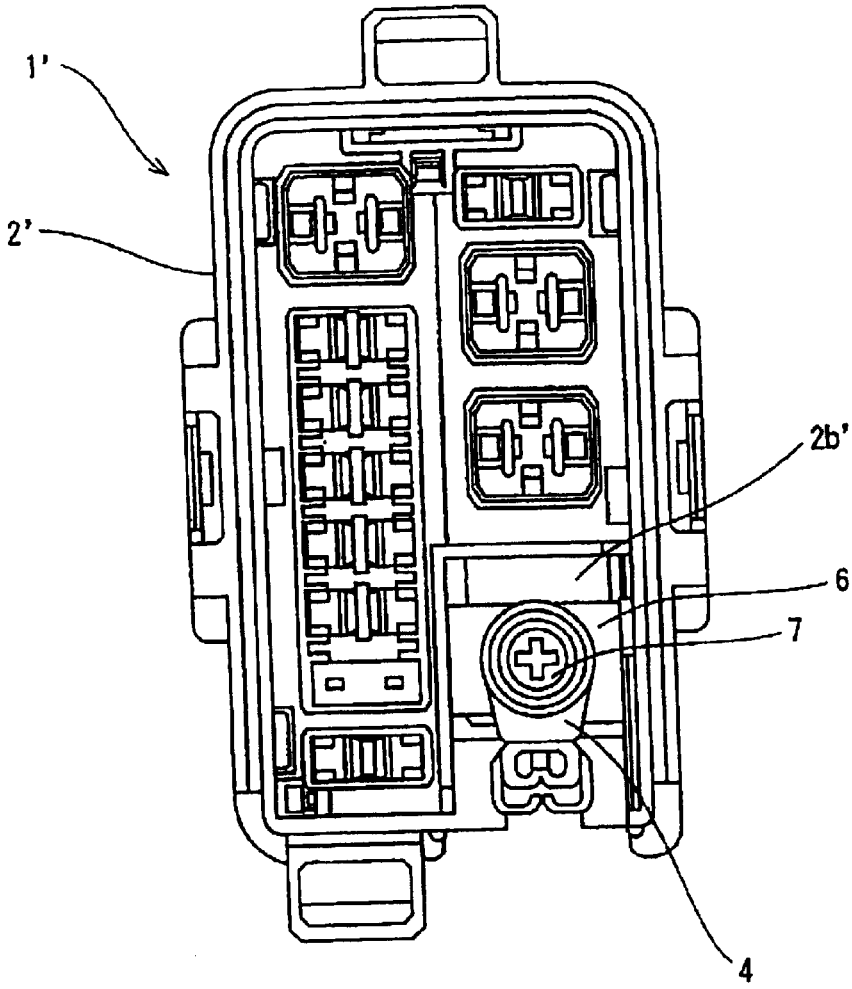
FIG. 7 PRIOR ART
FIG. 7 is a top plan view of a second type of conventional electrical connector box.
Figure 8:
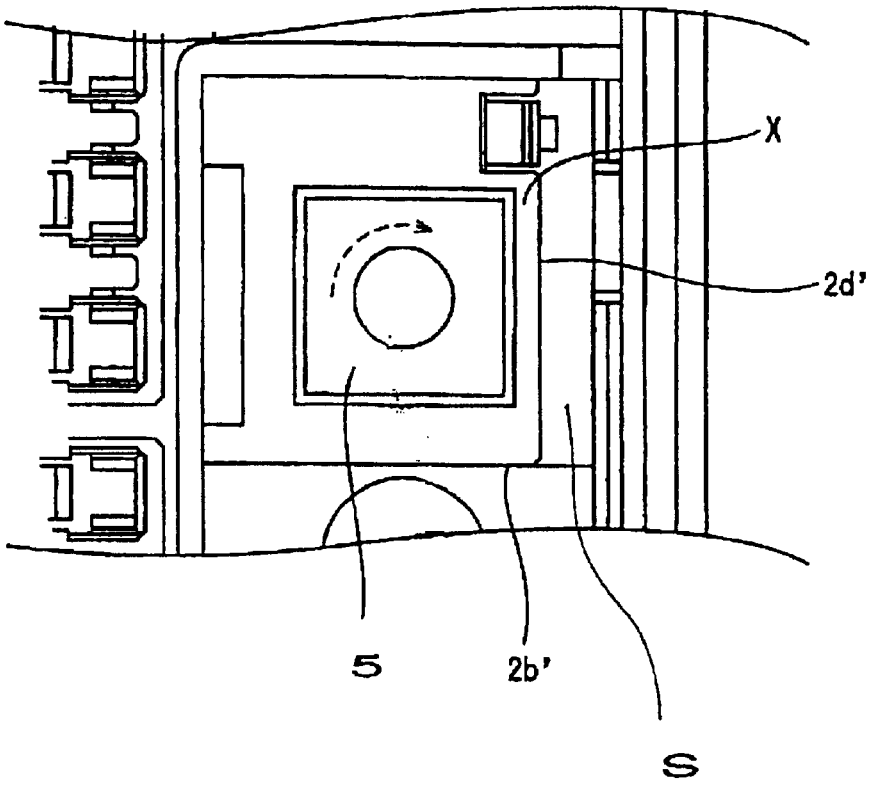
FIG. 8 PRIOR ART
FIG. 8 is an enlarged partial view of the conventional electrical connector box shown in FIG. 7.

As shown in FIG. 5, LA terminal 40, which includes a ring shaped terminal through which a bolt may be inserted, is attached to the end of power lead w, and is bent into an L-shape. The LA terminal 40 includes vertical wire crimping collar 40*a*, and contact flange 40*b* into which bolt hole 40*c* is formed. The contact flange 40*b* may be bent into a horizontal plane at the location of the vertical wire crimping collar 40*a*.

Power lead w is connected to circuit bus bar 14 of electrical connector box 10 through the following procedure. As shown in FIGS. 1 and 5, the LA terminal wire crimping collar 40*a*, which anchors power lead w to the LA terminal 40, is placed along the nut bracket outer wall disposed at a 90-degree angle to the first outer wall 20*c* (also between first outer wall 20*c* and second outer wall 20*d*). The contact flange 40*b* is placed over circuit bus bar upper portion 14*a* which rests on upper surface 20*a* of nut bracket 20. The LA terminal bolt hole 40*c* is aligned with bolt hole 14*b* in the circuit bus bar 14, and the threaded hole in nut 16.

Bolt 15 is inserted through washer 19, bolt holes 40*c* and 14*b*, and then screwed into nut 16 to secure the connection between the LA terminal 40 and the circuit bus bar 14.

While nut bracket 20 supports nut 16 and absorbs the load generated by tightening bolt 15 into nut 16, thin wall section X, which is located at the perimeter of nut 16, could be easily damaged by the tightening load without the reinforcement bus bar 22. Reinforcement bus bar 22, however, reinforces thin wall section X by being positioned against the external wall of the nut bracket 20, and reinforcement bus bar 22 is itself reinforced its position adjacent to and in contact with the circuit bus bar 14. Thin wall section X is thus reinforced to the extent that damage resulting from the load applied by tightening bolt 15 may be avoided.

In addition, the structure whereby reinforcement bus bar 22 is placed in contact with circuit bus bar 14 has the effect of preventing thermal buildup within circuit bus bar 14 to which power lead w connects.

It is noted that the invention is not limited solely to the above-described embodiment. For example, reinforcement bus bar 22 may reinforce thin wall section X by being located between nut bracket first outer wall 20*c* and circuit bus bar 14 in contact with outer wall 20*c*. Moreover, a device other than a threaded bolt may be used to join reinforcement bus bar 22 and circuit bus bar 14. Also, while it is not required that a wall of the nut bracket other than the thin wall section be reinforced, extending the ends of the U-shaped reinforcement bus bar can improve heat dissipation.

As previously mentioned, the electrical connector box of the present invention, through the application of a reinforcement bus bar to strengthen the region of the nut bracket in which the threaded nut is molded, prevents the thin wall section of the nut bracket from damage which can result from the load applied to the nut bracket by tightening the bolt into the nut when the power lead LA terminal is attached to the bus bars.

Moreover, the circuit bus bar, to which the power lead is connected, can be prevented from overheating by the attachment of the reinforcement bus bar to the circuit bus bar.

Furthermore, because a structure is used wherein the reinforcement bus bar is positioned between an outer wall of the nut bracket and the circuit bus bar, the connector box case need not be constructed to specifically strengthen the nut bracket. An increase in production cost is thus avoided because new tooling need not be fabricated to manufacture the case to which the invention is applied.

The present disclosure relates to subject matter contained in priority Japanese Application No. JP 2002-235208, filed on Aug. 12, 2002, which is herein expressly incorporated by reference in its entirety.

What is claimed is:

1. An electrical connector box including a nut bracket and a threaded nut molded therein, a circuit bus bar, and an L-shaped electrical power lead terminal connector, the circuit bus bar and the L-shaped terminal connector configured to be attached to an upper surface of the nut bracket by a threaded bolt fastened to the nut by passing through bolt holes provided in the L-shaped terminal connector and the circuit bus bar, said electrical connector box comprising:

a reinforcement bus bar extending downwardly along a first outer wall of said nut bracket between said first outer wall of said nut bracket and a vertical portion of said circuit bus bar.

2. The electrical connector box according to claim 1 wherein lower ends of said circuit bus bar and said reinforcement bus bar are angled and joined together by a threaded bolt.

3. The electrical connector box according to claim 1 wherein said circuit bus bar is configured as a C-shaped member, said reinforcement bus bar is configured as a U-shaped member, lower portions of both said circuit bus bar and said reinforcement bus bar are bolted together, and a vertical portion of said reinforcement bus bar reinforces a nut bracket wall other than said first outer wall along which said reinforcement bus bar extends downwardly.

4. An electrical connector box comprising:

a case;

a nut bracket provided integrally with said case, said nut bracket including a threaded nut molded into an upper portion thereof, a first outer wall extending downwardly from said upper portion, and a thin walled section of said first outer wall provided in said upper portion adjacent said threaded nut, said threaded nut configured for receiving a threaded bolt therein;

a wiring space defined between a case wall and said nut bracket first outer wall;

a terminal connector including a bolt hole, said terminal connector fastened to an upper surface of said upper portion of said nut bracket by said threaded nut and a bolt;

a circuit bus bar including a bolt hole, said circuit bus bar fastened to said upper surface of said upper portion of said nut bracket by said threaded nut and bolt, said circuit bus bar including a vertical portion extending downwardly from said upper portion of said nut bracket into said wiring space between said case wall and said nut bracket first outer wall; and a reinforcement member including a first vertical portion extending downwardly into said wiring space between said nut bracket first outer wall and said circuit bus bar vertical portion, wherein said reinforcement member and said circuit bus bar fill said wiring space and protect said thin walled section from damage due to bolt tightening.

5. The electrical connector box according to claim 4;

said nut bracket further comprising a second outer wall extending downwardly from said upper portion, said second outer wall positioned opposite said first outer wall, and said first and second outer walls extending to a lower portion of said nut bracket; and said reinforcement member comprising a horizontal portion extending along a lower surface of said lower portion of said nut bracket and a second vertical portion extending upwardly from said lower portion of said nut bracket along said second outer wall so that said first vertical portion, said horizontal portion, and said second vertical portion of said reinforcement member form a U-shaped member.

6. The electrical connector box according to claim 5;

said circuit bus bar comprising a first horizontal portion extending along said upper surface of said nut bracket and a second horizontal portion extending along said lower surface of said lower portion of said nut bracket so that said first horizontal portion, said vertical portion, and said second horizontal portion of said circuit bus bar form a C-shaped member.

7. The electrical connector box according to claim 6;

said nut bracket further comprising a second threaded nut molded into said lower portion of said nut bracket; and said horizontal portion of said reinforcement member and said second horizontal portion of said circuit bus bar each comprising a bolt hole therein, said reinforcement member and said circuit bus bar connected to said lower portion of said nut bracket by a threaded bolt through said bolt holes and fastened to said second threaded nut.

8. The electrical connector box according to claim 7, wherein said reinforcement member and said circuit bus bar are positioned in contact with each other such that heat dissipation is promoted.

9. The electrical connector box according to claim 7, said electrical connector box further comprising:

a second circuit bus bar including a bolt hole, said second circuit bus bar extending along said lower surface and connected to said lower portion of said nut bracket by said second threaded nut and bolt.

10. The electrical connector box according to claim 4;

said terminal connector comprising an L-shaped terminal connector including a horizontal portion and a vertical portion, said vertical portion including a lead crimped in a crimping collar of said L-shaped terminal.

11. The electrical connector box according to claim 10;

said nut bracket further comprising a third outer wall between said first and second outer walls and extending downwardly from said upper portion; and said horizontal portion of said L-shaped terminal connector extending along said upper surface of said nut bracket and said vertical portion of said L-shaped terminal connector extending along said third outer wall.

* * * * *